United States Patent [19]

Paranicas

[11] Patent Number: 4,518,834

[45] Date of Patent: May 21, 1985

[54] MATRIX SLIDE SWITCH

[75] Inventor: Peter C. Paranicas, Westbury, N.Y.

[73] Assignee: LVC Industries, Inc., Freeport, N.Y.

[21] Appl. No.: 529,949

[22] Filed: Sep. 7, 1983

[51] Int. Cl.[3] ..... H01H 15/00

[52] U.S. Cl. ..... 200/16 D; 200/253

[58] Field of Search ..... 200/16 R, 16 A, 16 B, 200/16 C, 16 D, 16 E, 16 F, 241, 242, 252, 253, 291, 292

[56] References Cited

U.S. PATENT DOCUMENTS

| | | | |
|---|---|---|---|
| Re. 24,586 | 1/1959 | Davis | 200/16 C |
| 1,908,204 | 5/1933 | Winning | 200/16 C |
| 3,582,578 | 6/1971 | Lockard | 200/16 D |
| 3,786,206 | 1/1974 | Kurimsky | 200/16 D |

*Primary Examiner*—A. D. Pellinen
*Assistant Examiner*—Morris Ginsburg
*Attorney, Agent, or Firm*—Kane, Dalsimer, Kane, Sullivan and Kurucz

[57] ABSTRACT

A matrix switch assembly has two boards on which facing surfaces carry conducting strips oriented in different directions. Slots through one of the boards are provided through which a switching element may slide to make contact between a strip associated with that slot and strips of the other board. The strips of the other board have indentations at each cross-over to provide indexing for the switching elements.

7 Claims, 11 Drawing Figures

MATRIX SLIDE SWITCH

BACKGROUND OF THE INVENTION

This invention relates to a switch assembly and more particularly to an assembly of switches which are individually able to connect each conductor of a first group to each conductor of a second.

Switch assemblies of the type described above are used in conjunction with devices which have a plurality of inputs and it is desired to set each one said inputs to a preselected value. The devices may involve analog or digital circuitry. Examples of such devices can be seen in U.S. Pat. Nos. 3,582,578; 3,786,206 and 3,493,706. However all these patents disclose fairly complicated and expensive constructions.

SUMMARY OF THE INVENTION

An objective of this invention is to provide a matrix switch assembly with a simple and inexpensive construction.

Another objective is to provide an assembly which may be manufactured by standard PCB (Printed Circuit Board) techniques.

A further objective is to provide an assembly with self-cleaning contacts.

Other objectives and advantages shall be pointed out in course of the preferred description of the invention.

The matrix switch assembly according to this invention comprises a first board, a second board and a plurality of switching elements disposed therebetween. The first board has a plurality of parallel slots extending in a first direction, and, on an inner surface, a conducting strip is associated with and surrounds each slot so that in effect each strip is partially split by the slot. The second board carries on a surface facing the said inner surface, a second plurality of strips extending parallel to each other in a second direction. Preferably the strips on the two boards are orthogonal to each other. The strips on the second board have indentations. Switching elements are disposed between the two boards so that each may slide across the boards. Each switch extends through one of the slots which provide a guiding means. As the switch slides through the slot it continuously contacts the upper or first strip associated with its slot and it crosses each of the lower or second strips. The indentations are provided at the crossover of the upper and lower switch and they are adapted to accommodate a portion of the switch element thus providing indexing means.

BRIEF DESCRIPTION OF THE FIGURES

FIG. 1*a* shows a blown up portion of FIG. 1 with the switching elements;

DESCRIPTION OF THE PREFERRED EMBODIMENT

Figure 1:
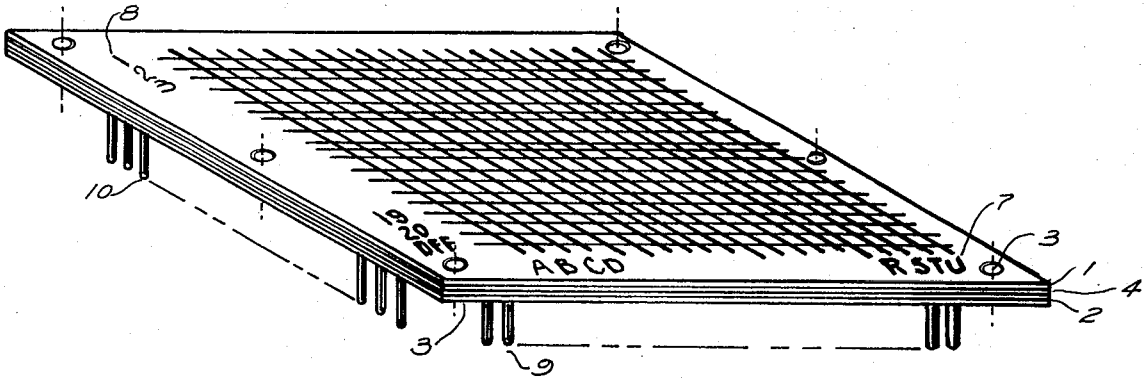
FIG. 1 and 1*a* respectively show an isometric view of the switch assembly.
Figure 1A:
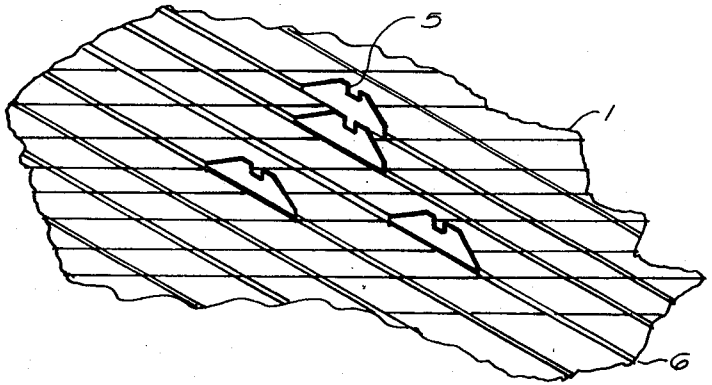

The complete switch assembly, as shown in FIGS. 1, and 1*a* comprises a top board 1, and bottom board 2 which are held together by fastening means 3. The fastening means may comprise a nut-and-bolt combination, a rivet, or any other suitable means well known in the art. The two boards are separated by a spacing frame 4 which extends all around the perimeter of the two boards. Thus the two boards and the spacing frame define a rectangular, shallow cavity, which houses the switching elements 5 described in more detail below.

The outer surface of the top board 1 has a plurality of slots 6 extending across said surface. Each slot is identified by marks 7 in any desirable manner, i.e. by letters or numbers, etc.

The switch elements slide across board 1 in slots 6 and each switch may take only certain positions determined by indexing means provided within the cavity. Each of these positions is identified by marks 8 provided on one side of board 1.

Associated with each slot there is a terminal 9 which is preferably affixed to the bottom board. Associated with each transversal position there is a terminal 10 also affixed to bottom board 2. Terminals 9 and 10 provide interconnecting means for input and output signals to and from the matrix switch assembly and may comprise a wire-wrap pin or other similarly well-known accessories. When a switch element corresponding to one of the slots 6 is in one of the positions 8, the terminal corresponding to said slot 6 is connected to the terminal corresponding to position 8.

Figure 2:
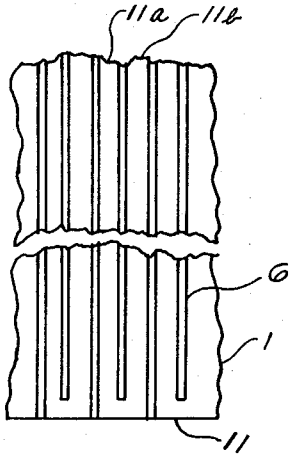
FIG. 2 is a partial plan view of the inner surface of the top board.

On its inner surface, shown in FIG. 2, the top board has a plurality of conducting strips 11. Preferably board 1 is a standard non-conducting PCB board on which strips 11 are formed by the usual techniques from copper, silver, or other similar conducting materials. Each strip 11 is divided by slot 6 into two long parts 11*a* and 11*b*. Parts 11*a* and 11*b* are interconnected at the two ends of each slot 6, as shown. Each one of the strips 11 is connected to a terminal 9 as described above.

Figure 4:
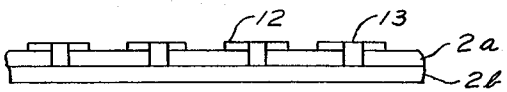
FIG. 4 is a partial sectional view of the lower board.
Figure 6:
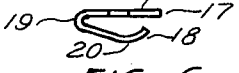
FIGS. 6, 7*a* and 7*b* show details of the switch conducting member.

The surface of the bottom board 2, facing top board 1 comprises a plurality of conducting strips 12. When the boards are assembled strips 12 are transversal to strips 11. The center line of the top strips 11 are indicated by phantom lines 11' to show the respective orientation of strips 11 and 12. Strips 12 are formed by the same methods as strips 11 described above. At the intersection of strips 11 and 12, strips 12 have rectangular holes 13 which are used as indexing means for the switch elements. Preferably board 2 comprises as shown in FIG. 4, a first sheet 2*a* in which rectangular holes 13 are cut through either before or after strips 12 are formed and a second sheet 2*b* which is provided to seal off holes 13 to keep away dirt and other impurities from the cavity formed by the boards.

Figure 5:
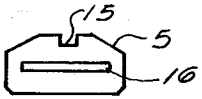
FIG. 5 shows the switch handle.
Figure 3:
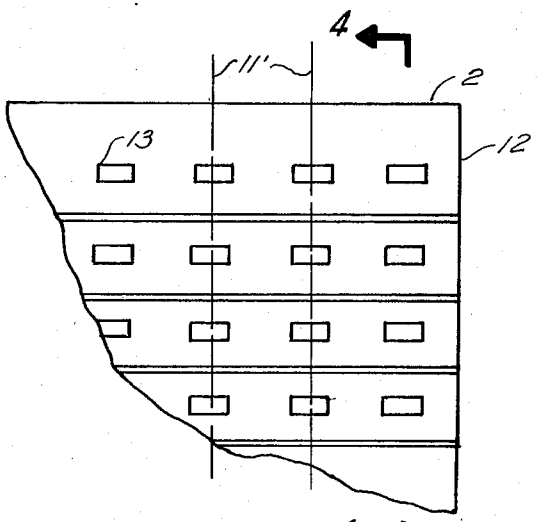
FIG. 3 is a partial plan view of the inner surface of the bottom board.

The switching elements comprise a handle 5 and a conducting member 14. The profile of handle 5 is shown in FIG. 5. It is made of a thin, non-conducting material and has a generally trapesoidal shape. On top the handle has a notch 15 which may be used to slide the switch element within slot 6 by using a flat instrument such as the head of a screw driver. A hole 16 is provided within the handle to accommodate conducting member 14.

Conducting member 14 has an upper arm 17 and a lower arm 18 connected by flexing elbow 19 which acts as a spring and permits arms 17 and 18 to move slightly toward or away from each other. While upper arm 17 is flat, the lower arm has a curved portion 20 bulging away from the upper arm 17. As it shall be described presently, the upper arm contacts the strips of the top board while the lower arm contacts the strips of the bottom board.

Figure 8:
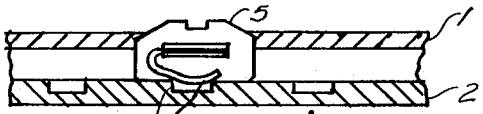
FIG. 8 shows a side view of the switch inserted between the boards.
Figure 9:
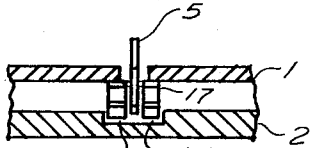
FIG. 9 shows an end view of the switch element as described in FIG. 8.
Figure 7A:
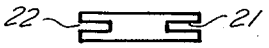
Figure 7B:
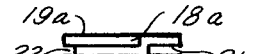

As can be best seen in FIG. 7*a* the upper arm has at its end opposite elbow 19 a notch 21. The elbow and the bottom arm are also split into two parts, respectively identified as 19*a*, 19*b* and 18*a*, 18*b* in FIG. 7*b*, by a slit 22. Slit 22 and notch 21 have approximately the same width and they are provided to allow conducting member 14 to be inserted into hole 16 of handle 5. The assembled switch element is shown in FIGS. 8 and 9. From these figures it can be seen that the conducting element is symetrically positioned with respect to the holder so that the two parts 18*a* and 18*b* of the lower arm are disposed on either side of handle 5.

The contacting member may be made out of copper, or any other similar material. Preferably it should be cut from sheet metal and then formed into the desired shape.

FIG. 8 shows the actual rest position of the switch element 5 between boards 1 and 2. Upper arm 17 of the element is in contact with strip 11 of top board 1. The lower arm is in contact with edges 23 and 24 which define hole 13. The distance between arms 17 and 18 in their relaxed state is slightly larger than the distance between boards 1 and 2 so that when the switch element is inserted therebetween, the two arms must be compressed together. Therefore while the switch elements are inserted between the boards the arms are continuously forced against the adjacent boards, thus insuring good electrical contact. The actual contact between the lower arm and board 2 is made between the curved portion 20 of the arm and edges 23 and 24 and is not affected by the depth of the hole. As the switch element is moved in either direction within slot 6 the upper arm 17 rides along and is in contact with strip 11. Meanwhile the lower arm rises until curved portion 20 clears the hole and rides across transverse strips 12 until the next hole. As the curved portion 20 enters a hole 13 a distinct click is produced and the force necessary to shift the switching element further is suddenly increased. Thus the indexing means is provided for the cross-over between the strips of the top board and the strips of the bottom board.

Furthermore it should be appreciated that as the switch element slides within slot 6, the arms continuously wipe the top strip, the bottom strips, and especially the edges of the holes thus providing a self-cleaning action and eliminating any impurities which might be injected in the matrix. Since the upper arm rides on both parts of the strip 11 contact will be made between the strip and the conducting member even if portions of strip 11 are contaminated.

It is clear that one skilled in the art may make modifications to the invention described herein without departing from its scope as defined in the appended claims. For example, the invention also contemplates incorporating LEDs into the unit so that LED will light when crosspoints are connected. This insures "contact" has been made and may be an advantage in a dimly lit area.

What is claimed is:

1. A matrix switch assembly comprising:

(a) a first insulating board having a plurality of parallel longitudinal slots extending in a first direction and a first surface with a first plurality of conductive strips disposed along and partially split by said slots:

(b) a second insulating board secured to said first board and having a second surface facing said first surface with a second plurality of conductive strips extending in a second direction, each said second conductive strip having a plurality of rectangular indexing holes, each hole being defined by at least two conductive edges spaced at a predetermined distance and oriented in said first direction; and (c) a plurality of switching means slidably disposed in said longitudinal slots, each switching means having a curved portion disposed between said first board and second board, said curved portion being larger than the distance between said edges so that when one of said switching means is positioned for contacting one of said second strips, electric contact is made between two points of said portion and the respective edges of the corresponding rectangular hole, at least one part of said portion being disposed below said edges, each switching means further having a conductive element in contact with said portion for contacting the corresponding first conductive strip.

2. The matrix switch assembly of claim 1 wherein said second direction is perpendicular to said first direction.

3. The matrix switch assembly of claim 1 wherein each said switching means comprises a flat nonconductive member extending through the corresponding slot and a conductive member having a first element which is substantially flat and extends in parallel with said first board for contacting the corresponding first conductive strip; a second element including said curved portion and a flexible element for biasing said first and second elements against the boards; and securing means for securing said conductive member to said flat member.

4. The matrix switch assembly of claim 3 wherein said flat member has an elongated hole in parallel with the corresponding slot and said conductive member has two opposed cuts oriented in the direction of the corresponding elongated hole, said hole and cuts being provided for securing said conductive member to said flat member.

5. The matrix switch assembly of claim 4 wherein one of said opposed cuts divides said curved portion into two subportions extending in the direction of the respective slot.

6. The matrix switch assembly of claim 4 wherein said conductive member extends across the corresponding longitudinal slot to engage the corresponding strip on both sides of the longitudinal slot.

7. The matrix switch assembly of claim 1 wherein said rectangular hole has a bottom and said curved portion does not contact said bottom.

* * * * *